US011226575B2

(12) United States Patent
Ohwada

(10) Patent No.: US 11,226,575 B2
(45) Date of Patent: Jan. 18, 2022

(54) IMAGING DEVICE

(71) Applicant: Hewlett-Packard Development Company, L.P., Spring, TX (US)

(72) Inventor: Satoshi Ohwada, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 3 days.

(21) Appl. No.: 17/254,430

(22) PCT Filed: Jun. 25, 2019

(86) PCT No.: PCT/US2019/039010
§ 371 (c)(1),
(2) Date: Dec. 21, 2020

(87) PCT Pub. No.: WO2020/023171
PCT Pub. Date: Jan. 30, 2020

(65) Prior Publication Data

US 2021/0124291 A1 Apr. 29, 2021

(30) Foreign Application Priority Data

Jul. 27, 2018 (JP) ..... JP2018-141560

(51) Int. Cl.
*G03G 15/20* (2006.01)

(52) U.S. Cl.
CPC ..... *G03G 15/2017* (2013.01); *G03G 15/2039* (2013.01); *G03G 15/2053* (2013.01); *G03G 2215/1685* (2013.01)

(58) Field of Classification Search
CPC ..... G03G 15/2017; G03G 15/2039; G03G 15/2053; G03G 2215/1685
See application file for complete search history.

(56) References Cited

U.S. PATENT DOCUMENTS

| | | | | |
|---|---|---|---|---|
| 5,778,294 | A | 7/1998 | Hiraoka et al. | |
| 2009/0245896 | A1* | 10/2009 | Ishikake | G03G 15/2064 399/328 |
| 2013/0302076 | A1* | 11/2013 | Sakamoto | G03G 8/00 399/341 |

FOREIGN PATENT DOCUMENTS

| | | | |
|---|---|---|---|
| JP | 2001-331049 | A | 11/2001 |
| JP | 2004-168043 | A | 6/2004 |
| JP | 2005-77732 | A | 3/2005 |
| JP | 2005-99719 | A | 4/2005 |
| JP | 2005-266415 | A | 9/2005 |
| JP | 2009-251021 | A | 10/2009 |
| JP | 2016-53670 | A | 4/2016 |
| KR | 10-2009-0035282 | A | 4/2009 |

* cited by examiner

*Primary Examiner* — Clayton E. LaBalle
*Assistant Examiner* — Michael A Harrison
(74) *Attorney, Agent, or Firm* — Jefferson IP Law, LLP

(57) ABSTRACT

An imaging system includes a heating device, a conveyor belt including a surface layer located on an outer surface of the heating device to receive a printing medium, and a cooling device to cool the surface layer after the conveyor belt passes along the outer surface of the heating device. The surface layer includes a temperature sensitive material to vary an adhesive force of the conveyor belt with respect to the printing medium in response to a change in temperature of the surface layer. The adhesive force increases in response to an increase in temperature of the surface layer.

20 Claims, 4 Drawing Sheets

IMAGING DEVICE

BACKGROUND

A printing device includes an endless belt which conveys a printing medium, a heating roll which heats the endless belt, and a pressing roll which presses the endless belt against the heating roll. The printing medium which is conveyed onto the endless belt is heated and pressed while passing between the heating roll and the pressing roll.

DETAILED DESCRIPTION

In the following description, with reference to the drawings, the same reference numbers are assigned to the same components or to similar components having the same function, and overlapping description is omitted. In some cases, drawings may be drawn in a simplified or exaggerated manner for the sake of clarity of example.

Figure 1:
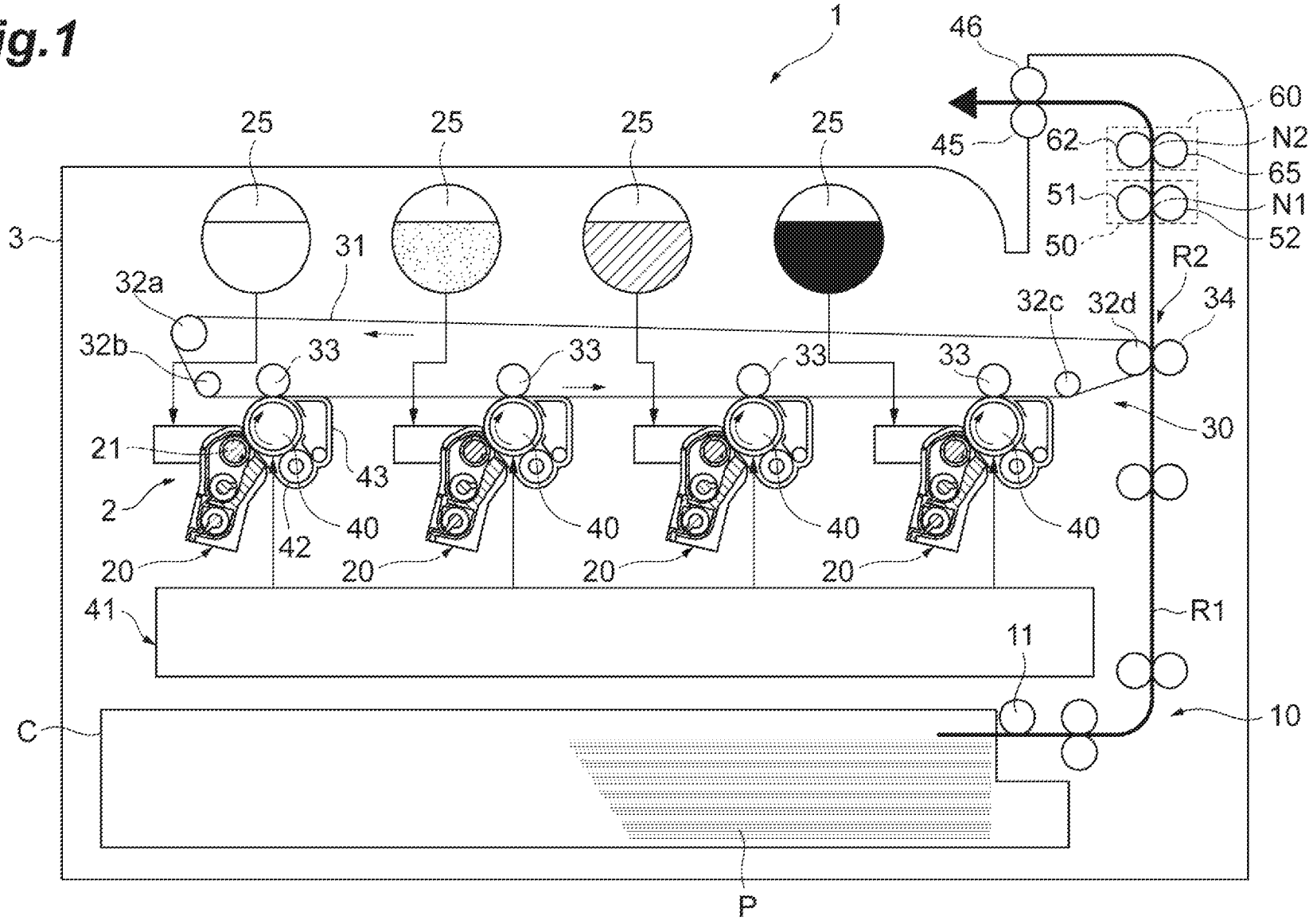
FIG. 1 is a schematic diagram of an example imaging system including a gloss control device.

As illustrated in FIG. 1, an example imaging system 1 forms a color image by using magenta, yellow, cyan, and black colors. The imaging system 1 may include an imaging apparatus or a gloss control device. Additionally, the imaging system 1 may be a printer or a component of an imaging system. For example, the imaging system 1 may comprise a developing device used in an imaging system or the like. The imaging system 1 includes, for example, a recording medium conveying device 10, a plurality of developing devices 20, a transfer device 30, a plurality of photosensitive bodies 40, a fixing device 50, and a gloss control device 60. The recording medium conveying device 10 conveys a printing medium P, such as a sheet. The photosensitive body 40 forms an electrostatic latent image and the developing device 20 develops the electrostatic latent image. The transfer device 30 secondarily transfers a toner image onto the printing medium P. For example, the fixing device 50 fixes the toner image onto the printing medium P and the gloss control device 60 controls the gloss of the toner image. In some examples, the fixing device 50 may be a primary fixing device which performs a first fixing operation of the printing medium P and the gloss control device 60 may be a secondary fixing device which performs a second fixing operation of the printing medium P.

The example recording medium conveying device 10 includes a feeding roller 11 which conveys the printing medium P having an image formed thereon along a conveying route R1. The printing medium P is stacked and accommodated in a cassette C and is picked up and conveyed by the feeding roller 11. The feeding roller 11 is provided, for example, in the vicinity of the outlet of the printing medium P of the cassette C. The recording medium conveying device 10 allows the printing medium P to reach a secondary transfer region R2 through the conveying route R1 at a timing in which the toner image transferred onto the printing medium P reaches the secondary transfer region R2.

In some examples, a separate developing device 20 may be provided for each color. Each developing device 20 includes a developing roller 21 which carries toner on the photosensitive body 40. In the developing device 20, toner and carrier may be adjusted so as to realize a predetermined mixing ratio and the toner is uniformly dispersed by mixing the toner and the carrier. A developing agent is carried on the developing roller 21. The developing roller 21 rotates so that the developing agent is conveyed to a region facing the photosensitive body 40. Then, the toner in the developing agent carried on the developing roller 21 moves to the electrostatic latent image of the photosensitive body 40 so that the electrostatic latent image is developed.

The transfer device 30 may convey the toner image formed by the developing device 20 and the photosensitive body 40 to the secondary transfer region R2. For example, an image developed on the photosensitive body 40 is transferred onto the transfer device 30. In some examples, the transfer device 30 includes a transfer belt 31, suspension rollers 32*a*, 32*b*, 32*c*, and 32*d*, a primary transfer roller 33, and a secondary transfer roller 34. The transfer belt 31 may be suspended by the suspension rollers 32*a*, 32*b*, 32*c*, and 32*d*. Additionally, a separate primary transfer roller 33 may be provided for each color. Each primary transfer roller 33 sandwiches the transfer belt 31 along with each photosensitive body 40. The secondary transfer roller 34 sandwiches the transfer belt 31 along with the suspension roller 32*d*.

The transfer belt 31 may include an endless belt which moves in a circulating manner by the suspension rollers 32*a*, 32*b*, 32*c*, and 32*d*. The primary transfer roller 33 presses the photosensitive body 40 from the inner peripheral side of the transfer belt 31. The secondary transfer roller 34 presses the suspension roller 32*d* from the outer peripheral side of the transfer belt 31. In some examples, the photosensitive body 40 includes a photosensitive drum that is provided for each color. The plurality of photosensitive bodies 40 are arranged in series along the movement direction of the transfer belt 31. A developing device 20, an exposure unit 41, a charging device 42, and a cleaning device 43 are provided at a facing position of the outer peripheral surface of each photosensitive body 40.

The example imaging system 1 may include a process cartridge 2 in which the developing device 20, the photosensitive body 40, the charging device 42, and the cleaning device 43 are integrally provided. Additionally, the imaging system 1 may include an apparatus body 3 to and from which the process cartridge 2 is attached and detached. The process cartridge 2 is attachable to or detachable from the apparatus body 3 in such a manner that a door of the apparatus body 3 is opened and the process cartridge 2 is inserted into or extracted from the apparatus body 3.

In some examples, the charging device 42 uniformly charges the outer peripheral surface of the photosensitive body 40 to a predetermined potential. The charging device 42 may include a charging roller that rotates to follow the rotation of the photosensitive body 40. The exposure unit 41 exposes the outer peripheral surface of the photosensitive body 40 charged by the charging device 42 in response to the image formed on the printing medium P. A potential of a portion exposed by the exposure unit 41 on the outer peripheral surface of the photosensitive body 40 changes and hence an electrostatic latent image is formed on the outer peripheral surface of the photosensitive body 40.

In some examples, toner tanks 25 are disposed in the plurality of developing devices 20 so as to face each other.

For example, magenta, yellow, cyan, and black toners are accommodated in the respective toner tanks 25. Toner is supplied from each toner tank 25 to each developing device 20. Each developing device 20 develops an electrostatic latent image by the supplied toner and forms a toner image on the outer peripheral surface of the photosensitive body 40. The toner image formed on the outer peripheral surface of the photosensitive body 40 is initially transferred onto the transfer belt 31 and the toner remaining on the outer peripheral surface of the photosensitive body 40 after the toner image is transferred is removed by the cleaning device 43.

The fixing device 50 fixes, for example, the toner image secondarily transferred from the transfer belt 31 onto the printing medium P onto the printing medium P. As an example, the fixing device 50 includes a heating roller 51 which heats the printing medium P and fixes the toner image onto the printing medium P and a pressing roller 52 which presses the heating roller 51. One or both of the heating roller 51 and the pressing roller 52 may be formed in a cylindrical shape.

A heat source such as a halogen lamp may be provided inside the heating roller 51. Furthermore, a heat source such as a halogen lamp may be provided inside the pressing roller 52. A nip portion N1 which is a fixing region of the printing medium P is provided between the heating roller 51 and the pressing roller 52. When the printing medium P passes through the nip portion N1, the toner image is melted and fixed onto the printing medium P.

In some examples, the gloss control device 60 allows the image of the printing medium P to be glossy by smoothing the toner of the printing medium P onto which the toner image is melted and fixed by the fixing device 50. The gloss control device 60 improves the glossiness of the image by melting and pressing fine unevenness of the toner formed on the printing medium P and smoothing the toner. An example configuration of the gloss control device 60 will be described in further detail later. Furthermore, the imaging system 1 may include discharge rollers 45 and 46 which discharge the printing medium P (of which the gloss of the image is controlled by the gloss control device 60) to the outside of the imaging system 1.

An example imaging method may comprise a printing process using the imaging system 1. For example, when an image signal of a target recording image is input to the imaging system 1, the printing medium P stacked in the cassette C is picked up by the rotation of the feeding roller 11 and the printing medium P is conveyed along the conveying route R1. Then, the charging device 42 uniformly charges the outer peripheral surface of the photosensitive body 40 to be a predetermined potential based on the image signal. Additionally, an electrostatic latent image is formed on the outer peripheral surface of the photosensitive body 40 in such a manner that the exposure unit 41 irradiates a laser beam onto the outer peripheral surface of the photosensitive body 40.

Next, the developing device 20 performs a developing operation by forming a toner image on the photosensitive body 40. For example, the toner image is initially transferred from each photosensitive body 40 onto the transfer belt 31 in a region in which each photosensitive body 40 faces the transfer belt 31. The toner images respectively formed on the plurality of photosensitive bodies 40 may be sequentially laminated on the transfer belt 31 to form one laminated toner image. The laminated toner image is secondarily transferred onto the printing medium P conveyed from the recording medium conveying device 10 in the secondary transfer region R2 in which the suspension roller 32*d* the secondary transfer roller 34 face each other.

The printing medium P onto which the laminated toner image is secondarily transferred is conveyed from the secondary transfer region R2 to the fixing device 50. For example, the fixing device 50 melts and fixes the laminated toner image onto the printing medium P by allowing the printing medium P to pass through the nip portion N1 while applying a heat and a pressure to the printing medium P. Additionally, the printing medium P onto which the laminated toner image is melted and fixed may be conveyed to the gloss control device 60. The gloss control device 60 smoothes the toner by melting and pressing the toner of the laminated toner image again.

The gloss control device 60 hardens the toner by cooling the printing medium P having the smoothed laminated toner image. Accordingly, the gloss control device 60 improves the glossiness of the image of the printing medium P so that the image of the printing medium P becomes close to the photo image. As a result, a high quality image may be obtained. The printing medium P having image quality improved by the gloss control device 60 is discharged to the outside of the imaging system 1 by, for example, the discharge rollers 45 and 46.

Figure 2:
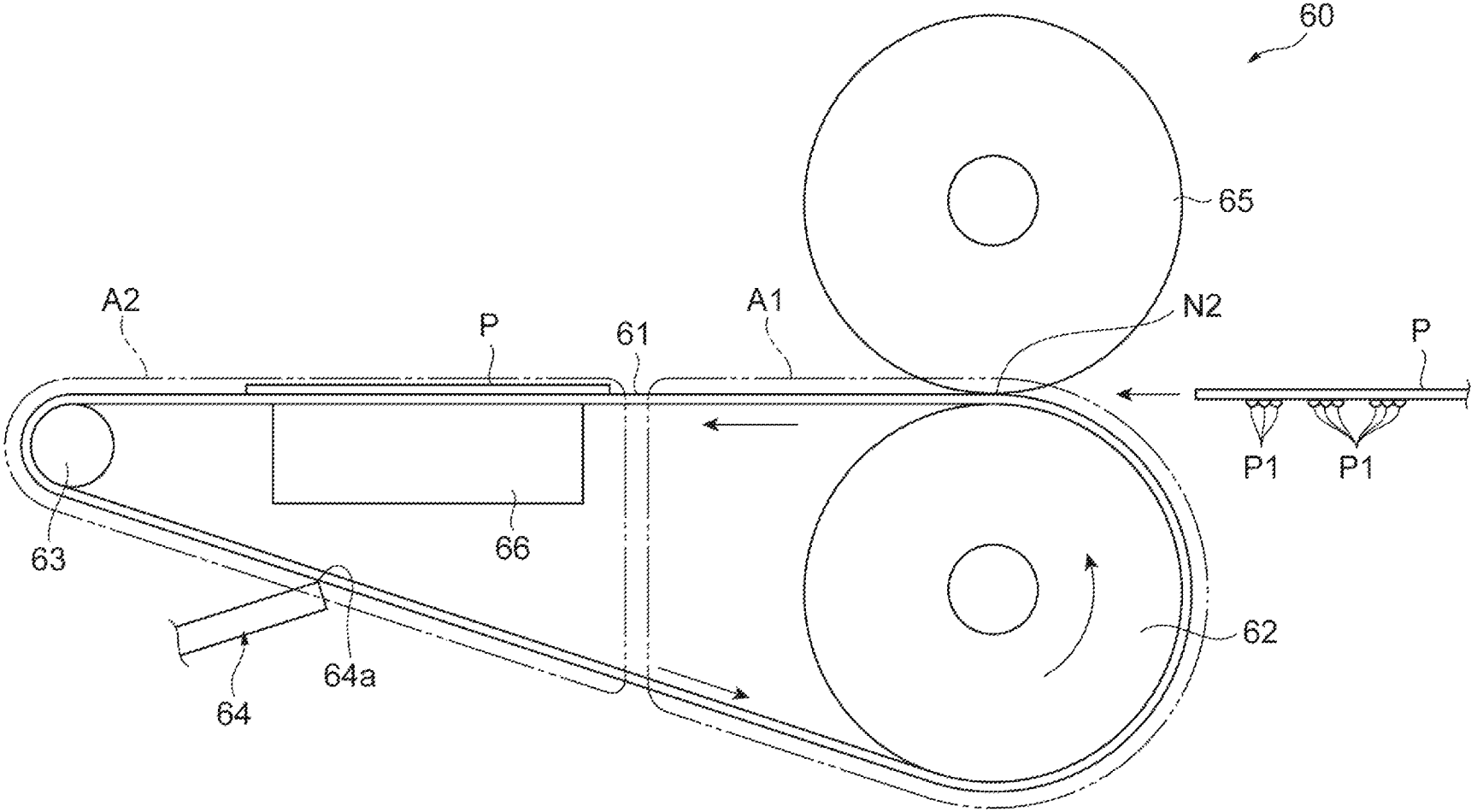
FIG. 2 is a diagram illustrating the example gloss control device of FIG. 1.

With reference to FIG. 2, an example gloss control device 60 will be described in more detail.

As illustrated in FIG. 2, the example gloss control device 60 includes a conveyor belt 61, a heating device 62 and a support roller 63 which may include rotation bodies suspending the conveyor belt 61. Additionally, the gloss control device 60 may include a cleaner 64 which cleans the conveyor belt 61, a pressing portion 65 (which may include a rotating body) pressing the printing medium P, and a cooling device 66 which cools the conveyor belt 61. The heating device 62 may include a roll-shaped heating roller and the heating device 62 may include a belt-shaped heating belt. In some examples, the conveyor belt 61 passes along the outer surface of the heating device 62 and loads the printing medium P thereon. The conveyor belt 61 conveys the printing medium P. The heating device 62, the support roller 63 and the cooling device 66 may be provided inside the conveyor belt 61. The cleaner 64 and the pressing portion 65 may be provided outside the conveyor belt 61.

The heating device 62 heats the conveyor belt 61 and generates a high temperature region A1 inside the imaging system 1. Meanwhile, the cooling device 66 cools the conveyor belt 61 and generates a low temperature region A2 inside the imaging system 1. In some examples, the high temperature region A1 may be a region including the heating device 62 and may include the conveyor belt 61 heated by the heating device 62. The low temperature region A2 may be a region including the cooling device 66 and may include, for example, the support roller 63, the cleaner 64, and the conveyor belt 61 cooled by the cooling device 66.

The heating device 62 may include a free belt which is operated by the external power of the gloss control device 60. Additionally, a nip portion N2 which is a fixing region of the printing medium P may be provided between the heating device 62 and the pressing portion 65. A contact pressure is exerted between the heating device 62 and the pressing portion 65. The nip portion N2 is formed by the contact pressure. The nip portion N2 may include a re-melting portion which re-melts the toner P1 of the printing medium P. When the printing medium P passes through the nip portion N2, the toner P1 of the printing medium P is smoothed.

In some examples, the support roller 63 supports the conveyor belt 61 from the inside of the conveyor belt 61 and the conveyor belt 61 moves in a circulating manner along the outer peripheries of the heating device 62 and the support roller 63. The printing medium P is conveyed along the conveyor belt 61 and passes along the nip portion N2 and the cooling device 66. Then, the printing medium P is peeled off from the support roller 63 and is conveyed to the outside of the gloss control device 60. The pressing portion 65 may be formed as a roll-shaped pressing roll or some other shape. In some examples, the surface hardness of the pressing portion 65 may be equal to between approximately 45 and 80 in ASKER-C hardness. The heating device 62 may include, for example, a rigid body, and the surface hardness of the heating device 62 may be equal to or smaller than the surface hardness of the pressing portion 65.

In some examples, the cooling device 66 may include at least one of a heat sink contacting the opposite side of the printing medium P in the conveyor belt 61, and a fan blowing air to the conveyor belt 61. Further, the cooling device 66 may include at least one of a Peltier element and a heat pipe. For example, the cooling device 66 cools and hardens the toner P1 of the printing medium P smoothed while passing through the nip portion N2.

The cleaner 64 may include a blade which contacts the conveyor belt 61 in the low temperature region A2. A material of the blade of the cleaner 64 may include a material, such as felt, that is softer than the conveyor belt 61. The cleaner 64 may be disposed to obliquely extend toward the upstream side of the conveyor belt 61 from a contact portion 64*a* with respect to the conveyor belt 61. In some examples, a configuration of the cleaner 64 may not include the blade with felt. Instead of, or in addition to, the felt, the cleaner 64 may include a brush contacting the conveyor belt 61.

Figure 3:
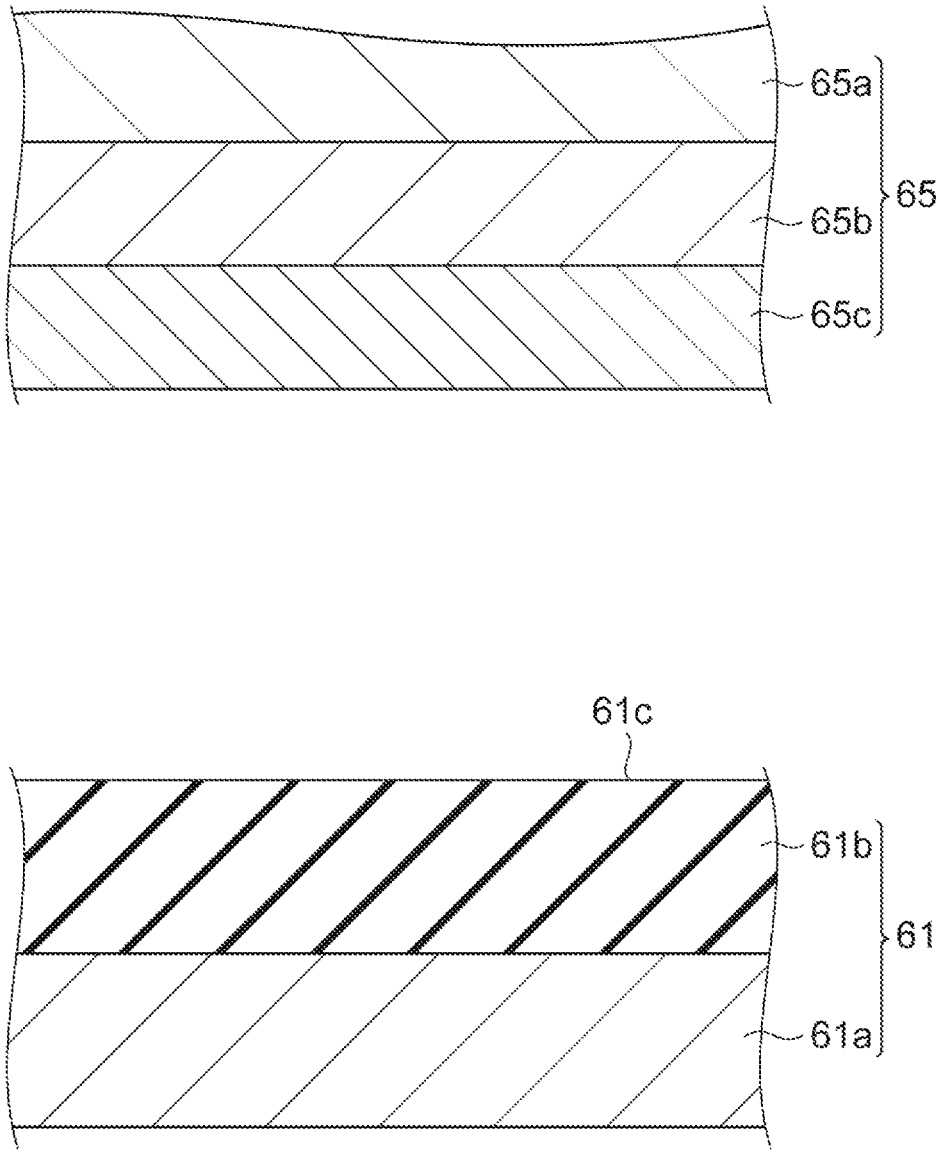
FIG. 3 is a cross-sectional view illustrating an example layer structure of a pressing roll and a conveyor belt of the gloss control device of FIG. 2.

With reference to FIG. 3, an example configuration of the conveyor belt 61 and the pressing portion 65 will be described in further detail. FIG. 3 is a diagram illustrating an example layer structure of the conveyor belt 61 and the pressing portion 65. The conveyor belt 61 may include a base layer 61*a* and a surface layer 61*b* and a pressing portion 65 includes a base layer 65*a*, an intermediate layer 65*b*, and a surface layer 65*c*. Additionally, the surface layer 61*b* may include a smooth surface 61*c* on which the printing medium P is loaded and the smooth surface 61*c* of the surface layer 61*b* may have a high glossiness. The base layer 61*a* is located at the opposite side of the printing medium P when viewed from the surface layer 61*b*. The base layer 65*a*, the intermediate layer 65*b*, and the surface layer 65*c* may be arranged in this order from the inside to the outside of the pressing portion 65 in the radial direction.

The surface layer 61*b* of the conveyor belt 61 may include a layer which conveys the loaded printing medium P. The surface layer 61*b* includes a temperature sensitive material of which an adhesive force of the conveyor belt 61 with respect to the printing medium P changes in response to a change in temperature of the surface layer 61*b*. For example, the adhesive force of the surface layer 61*b* increases in response to an increase in temperature of the surface layer 61*b*. Additionally, the adhesive force of the surface layer 61*b* may decrease as the temperature of the surface layer 61*b* decreases. In some examples, the adhesive force of the surface layer 61*b* in the high temperature region A1 increases to a degree in which peeling-off of the printing medium P is suppressed. The adhesive force of the surface layer 61*b* in the low temperature region A2 decreases to a degree in which the printing medium P may be peeled off.

In the high temperature region A1 in which the adhesive force of the surface layer 61*b* is high, the toner P1 having unevenness may be more reliably melted and smoothed by controllably transmitting heat to the printing medium P. Further, in the low temperature region A2 in which the adhesive force of the surface layer 61*b* is low, the printing medium P may be smoothly peeled off from the support roller 63. Since the adhesive force of the surface layer 61*b* of the conveyor belt 61 located in the low temperature region A2 is low, dirt of residual toner may be easily removed from the surface layer 61*b* by the cleaner 64 located in the low temperature region A2.

Figure 4:
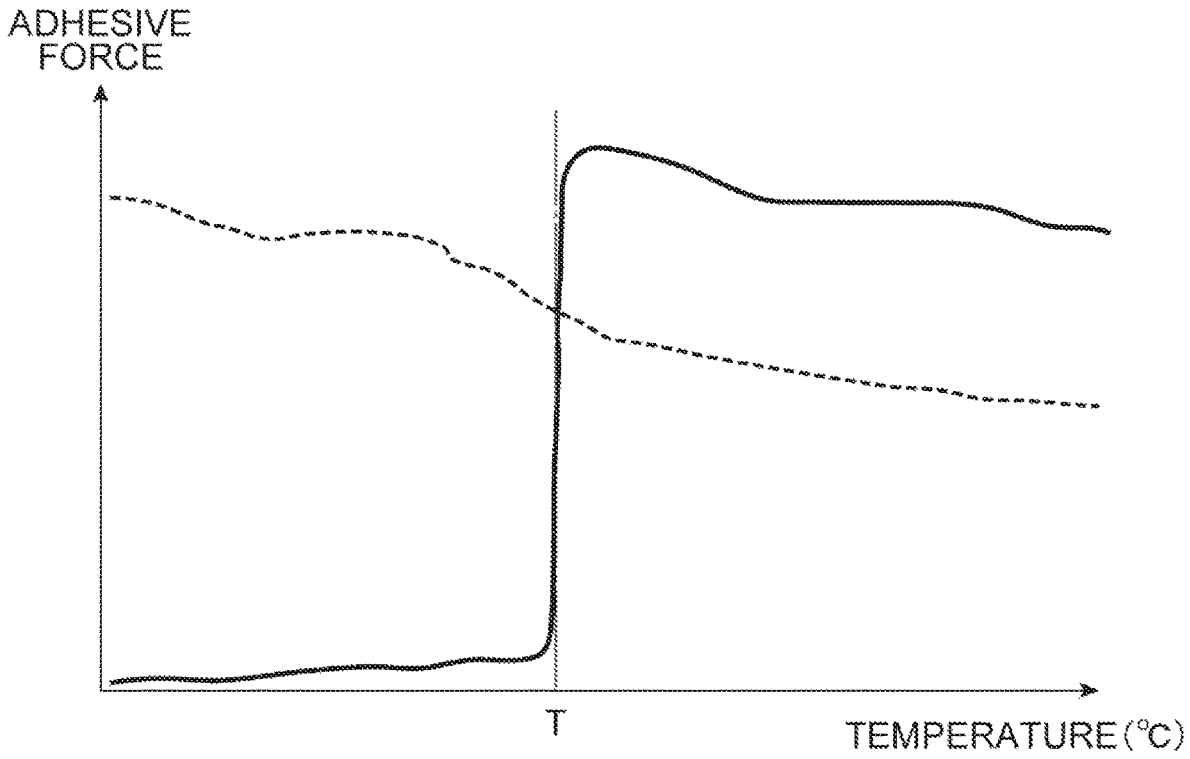
FIG. 4 is a graph showing an example relationship between an adhesive force and a temperature of a surface layer of the conveyor belt.

FIG. 4 is a graph showing an example relationship between the adhesive force and the temperature of the material of the surface layer of the conveyor belt. In FIG. 4, the solid line indicates the adhesive force and the temperature of the surface layer 61*b* of the conveyor belt 61. The dashed line indicates a comparative example different from the surface layer 61*b*. In the case of the conveyor belt of the comparative example, the adhesive force decreases as the temperature of the surface layer increases. In the case of the temperature sensitive material of the surface layer 61*b* of the conveyor belt 61, the adhesive force is small as it is close to 0, for example, when the temperature is lower than the temperature threshold value T. However, the adhesive force can be increased when the temperature is equal to or higher than the temperature threshold value T.

In some examples, the adhesive force of the surface layer 61*b* of the high temperature region A1 is higher than the adhesive force between the base layer 65*a* and the intermediate layer 65*b*, and higher than the adhesive force between the intermediate layer 65*b* and the surface layer 65*c* illustrated in FIG. 3. The adhesive force of the surface layer 61*b* when the temperature is equal to or higher than the temperature threshold value T is higher than the stiffness of the printing medium P. Accordingly, the printing medium P may continue to adhere to the conveyor belt 61 in the high temperature region A1 of the outlet of the nip portion N2.

The surface layer 61*b* ensures the adhesiveness with respect to the printing medium P when the temperature is equal to or higher than the temperature threshold value T, and allows the printing medium P to be separable when the temperature is lower than the temperature threshold value T. For example, the surface layer 61*b* has high adhesiveness when the temperature is equal to or higher than the temperature threshold value T and has easy peelability when the temperature is lower than the temperature threshold value T. Additionally, the surface layer 61*b* may be a temperature sensitive adhesive sheet adhering to the base layer 61*a* of the conveyor belt 61. The example conveyor belt 61 includes the surface layer 61*b* of which the adhesiveness is controlled in a plurality of levels by the control of the temperature. In some examples, the temperature threshold value T is equal to between approximately 35° C. and 45° C.

The temperature sensitive material of the surface layer 61*b* may include side-chain crystalline resin. For example, the temperature sensitive material of the surface layer 61*b* may include acrylic resin and/or polystearyl acrylate. In some examples, the surface layer 61*b* causes a phase transition by using the temperature threshold value T as a boundary. When the temperature is equal to or higher than the temperature threshold value T or the temperature is lower than the temperature threshold value T, the adhesive property of the surface layer 61*b* changes. In some examples, the temperature sensitive material of the surface layer 61*b* is non-crystallized when the temperature becomes equal to or higher than the temperature threshold value T due to the heating, is crystallized when the temperature is lower than the temperature threshold value T due to the cooling, and performs a phase transition by using the temperature threshold value T as a boundary.

The adhesive property of the temperature sensitive material of the surface layer 61*b* may change in response to a value above or below the temperature threshold value T. In the high temperature region A1 in which the temperature is higher than the temperature threshold value T, the printing medium P is not easily peeled off from the surface layer 61*b* since the adhesiveness of the surface layer 61*b* increases. Meanwhile, in the low temperature region A2 in which the temperature is lower than the temperature threshold value T, the printing medium P is easily peeled off from the surface layer 61*b* since the adhesiveness of the surface layer 61*b* is low. Thus, when the toner P1 of the printing medium P is melted in the nip portion N2 and the temperature of the surface layer 61*b* is equal to or higher than the temperature threshold value T, the printing medium P may continue to be adhered to the conveyor belt 61 due to the high adhesive force of the surface layer 61*b*.

Additionally, the printing medium P may be smoothly peeled off from the conveyor belt 61 due to the curvature of the conveyor belt 61 in the support roller 63 after the printing medium P is cooled so that the temperature becomes lower than the temperature threshold value T. Since the adhesive property of the temperature sensitive material of the surface layer 61*b* changes due to the temperature difference inside the gloss control device 60, the relationship between the temperature difference inside the gloss control device 60 and the adhesive force of the temperature sensitive material may be effectively used to control the adhesive force.

As described above, in the example gloss control device 60 and the imaging system 1, the separation of the printing medium P due to the surface layer 61*b* having a high adhesive force may be suppressed, since the temperature of the surface layer 61*b* in the nip portion N2 and the high temperature region A1 in the periphery thereof is equal to or higher than the temperature threshold value T. By improving the heat transmission efficiency to the printing medium P in the nip portion N2, a stable image may be obtained while suppressing the unevenness of the toner P1. Further, the stable image may be obtained with suppressed cooling unevenness and the printing medium P may be smoothly peeled off in the low temperature region A2 in which the adhesive force is low.

since the adhesive property of the surface layer 61*b* of the conveyor belt 61 may be selectively controlled in response to a change in temperature, one or more of the systems and method described herein may be used regardless of the type of the printing medium P or the type of toner P1. Thus, the gloss control device 60 and the imaging system 1 can be used in a versatile manner, with different types of printing medium and toner. Further, by omitting a component that presses the printing medium against the conveyor belt and/or by omitting other components such as a component used to vacuum the printing medium, as described herein, a reduced size and cost of the gloss control device 60 and the imaging system 1 may be achieved.

It is to be understood that not all aspects, advantages and features described herein may necessarily be achieved by, or included in, any one particular example. Indeed, having described and illustrated various examples herein, it should be apparent that other examples may be modified in arrangement and detail is omitted. For example, at least one of the conveyor belt 61, the heating device 62, and the pressing portion 65 may not be a rotating body.

The invention claimed is:

1. An imaging system comprising:

a heating device;

a conveyor belt including a surface layer located on an outer surface of the heating device to receive a printing medium; and a cooler to cool the surface layer after the conveyor belt passes along the outer surface of the heating device, wherein the surface layer includes a temperature sensitive material formed of side-chain crystalline resin to vary an adhesive force of the conveyor belt with respect to the printing medium in response to a change in temperature of the surface layer, the adhesive force to increase in response to an increase in the temperature of the surface layer.

2. The imaging system according to claim 1, wherein the temperature sensitive material is formed of acrylic resin.

3. The imaging system according to claim 1, wherein the surface layer is formed of the temperature sensitive material to increase the adhesive force when the temperature is equal to or higher than a predetermined temperature threshold value, and to decrease the adhesive force when the temperature is lower than the temperature threshold value.

4. The imaging system according to claim 3, wherein the temperature sensitive material performs a phase transition using the temperature threshold value as a boundary.

5. The imaging system according to claim 3, wherein the temperature threshold value is greater than or equal to 35° C. and less than or equal to 45° C.

6. The imaging system according to claim 1, further comprising:

a cleaner to contact a portion of the conveyor belt cooled by the cooler.

7. The imaging system according to claim 6, wherein the cleaner is provided outside the conveyor belt.

8. The imaging system according to claim 1, wherein the heating device is to generate a high temperature region inside the imaging system, wherein the cooler is to generate a low temperature region having a temperature lower than that of the high temperature region inside the imaging system, wherein the conveyor belt is to pass through both of the high temperature region and the low temperature region, and wherein the adhesive force of the surface layer is to increase in the high temperature region, and to decrease in the low temperature region.

9. The imaging system according to claim 8, further comprising:

a pressing roller to press the printing medium, wherein a nip portion corresponding to a fixing region of the printing medium is provided between the heating device and the pressing roller, and wherein the nip portion is provided in the high temperature region.

10. The imaging system according to claim 8, further comprising:

a support roller to support the conveyor belt, wherein the support roller is provided in the low temperature region, and wherein the printing medium is to be peeled off from the conveyor belt on the support roller.

11. The imaging system according to claim 1, wherein the heating device and the cooler are provided inside the conveyor belt.

12. The imaging system according to claim 1, further comprising:

a gloss control device including the conveyor belt, the heating device, and the cooler.

13. The imaging system according to claim 12, wherein the gloss control device is a secondary fixing device to perform a second fixing operation of the printing medium.

14. The imaging system according to claim 1, wherein the surface layer includes a smooth surface on which the printing medium is loaded.

15. An imaging system comprising:

a heating device;

a conveyor belt including a surface layer located on an outer surface of the heating device to receive a printing medium; and a cooler to cool the surface layer after the conveyor belt passes along the outer surface of the heating device, wherein the surface layer includes a temperature sensitive material that undergoes a phase transition to vary an adhesive force of the conveyor belt with respect to the printing medium in response to a change in temperature of the surface layer, the adhesive force to increase in response to an increase in the temperature of the surface layer.

16. The imaging system according to claim 15, wherein the temperature sensitive material is formed of side-chain crystalline resin.

17. The imaging system according to claim 15, wherein the temperature sensitive material is formed of acrylic resin.

18. The imaging system according to claim 15, wherein the surface layer is formed of the temperature sensitive material to increase the adhesive force when the temperature is equal to or higher than a predetermined temperature threshold value, and to decrease the adhesive force when the temperature is lower than the temperature threshold value, and wherein the phase transition occurs using the temperature threshold value as a boundary.

19. The imaging system according to claim 18, wherein the temperature threshold value is greater than or equal to 35° C. and less than or equal to 45° C.

20. The imaging system according to claim 15, further comprising a cleaner to contact a portion of the conveyor belt cooled by the cooler.

* * * * *